US010477916B2

(12) United States Patent
Hartenstein et al.

(10) Patent No.: US 10,477,916 B2
(45) Date of Patent: Nov. 19, 2019

(54) SOLE STRUCTURE FOR AN ARTICLE OF FOOTWEAR WITH FIRST AND SECOND MIDSOLE BODIES

(71) Applicant: NIKE, Inc., Beaverton, OR (US)

(72) Inventors: Sung Joo B. Hartenstein, Beaverton, OR (US); Doug D. Wilken, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 131 days.

(21) Appl. No.: 15/727,042

(22) Filed: Oct. 6, 2017

(65) Prior Publication Data

US 2018/0098601 A1 Apr. 12, 2018

Related U.S. Application Data

(60) Provisional application No. 62/406,176, filed on Oct. 10, 2016.

(51) Int. Cl.

| | |
|---|---|
| ***A43B 13/16*** | (2006.01) |
| ***A43B 7/14*** | (2006.01) |
| ***A43B 13/18*** | (2006.01) |
| ***A43B 13/38*** | (2006.01) |
| ***A43B 3/00*** | (2006.01) |
| ***A43B 13/14*** | (2006.01) |

(52) U.S. Cl.

CPC ..... *A43B 7/149* (2013.01); *A43B 3/0057* (2013.01); *A43B 7/141* (2013.01); *A43B 7/142* (2013.01); *A43B 7/144* (2013.01); *A43B 7/1445* (2013.01); *A43B 13/141* (2013.01); *A43B 13/145* (2013.01); *A43B 13/16* (2013.01); *A43B 13/186* (2013.01); *A43B 13/188* (2013.01); *A43B 13/38* (2013.01)

(58) Field of Classification Search

CPC ..... A43B 7/141; A43B 7/1425; A43B 7/144; A43B 13/18; A43B 13/16; A43B 13/186; A43B 13/188; A43B 23/045; A43B 23/047

USPC ..... 36/45, 25 R, 28, 30 R, 31

See application file for complete search history.

(56) References Cited

U.S. PATENT DOCUMENTS

| | | | | | |
|---|---|---|---|---|---|
| RE31,173 | E | * | 3/1983 | Daswick | A43B 5/06 36/103 |
| 4,658,516 | A | * | 4/1987 | Beck | A43B 13/16 12/142 RS |
| RE33,066 | E | * | 9/1989 | Stubblefield | A43B 7/144 36/83 |
| 4,897,936 | A | * | 2/1990 | Fuerst | A43B 13/12 36/114 |
| 5,077,916 | A | * | 1/1992 | Beneteau | A43B 5/001 36/128 |

(Continued)

*Primary Examiner* — Marie D Bays

(74) *Attorney, Agent, or Firm* — Quinn IP Law

(57) ABSTRACT

A sole structure for an article of footwear includes a first midsole body and a second midsole body. The first midsole body defines a ground-facing surface and a foot-facing surface opposite the ground-facing surface and includes a first midsole material, which has a first hardness. The second midsole body extends through the first midsole body. As such, the second midsole body extends beyond the ground-facing surface of the first midsole body. The second midsole body includes a second midsole material, which has a second hardness, and the first hardness is greater than the second hardness.

20 Claims, 8 Drawing Sheets

(56) References Cited

U.S. PATENT DOCUMENTS 5,367,791 A * 11/1994 Gross ..... A43B 13/181 36/25 R
5,423,135 A * 6/1995 Poole ..... A43B 13/223 36/116
5,815,949 A * 10/1998 Sessa ..... A43B 1/0072 36/3 B
5,862,614 A * 1/1999 Koh ..... A43B 13/223 36/31
6,061,929 A * 5/2000 Ritter ..... A43B 3/0052 36/107
6,115,945 A * 9/2000 Ellis, III ..... A43B 13/04 36/102
6,920,707 B1 * 7/2005 Greene ..... A43B 3/26 36/28
7,174,659 B2 * 2/2007 Delgorgue ..... A43B 13/223 36/31
7,200,955 B2 * 4/2007 Foxen ..... A43B 7/1425 36/25 R
7,392,604 B2 * 7/2008 Greene ..... A43B 3/24 36/25 R
7,918,041 B2 * 4/2011 Cho ..... A43B 7/081 36/28
8,671,589 B2 * 3/2014 Bond ..... A43B 13/223 36/114
2003/0192202 A1 * 10/2003 Schoenborn ..... A43B 7/142 36/30 R
2005/0268490 A1 * 12/2005 Foxen ..... A43B 7/1425 36/28
2007/0128403 A1 * 6/2007 Yang ..... A43B 7/144 428/67
2007/0277401 A1 * 12/2007 Young-Chul ..... A43B 13/12 36/30 R
2008/0313924 A1 * 12/2008 Righetto ..... A43B 7/144 36/28
2009/0014424 A1 * 1/2009 Meschter ..... A41D 31/02 219/121.69
2012/0260528 A1 10/2012 Cook et al.
2014/0075779 A1 * 3/2014 Bruce ..... A43B 13/20 36/29
2014/0215849 A1 8/2014 Litchfield et al.
2015/0075034 A1 3/2015 Cross et al.
2015/0223563 A1 * 8/2015 Liebeno ..... A43B 13/16 36/31
2015/0282561 A1 * 10/2015 Swager Van Dok ..... A43B 3/0057 36/31
2016/0242499 A1 8/2016 Droege et al.

* cited by examiner

MW
78
66
66
66

SOLE STRUCTURE FOR AN ARTICLE OF FOOTWEAR WITH FIRST AND SECOND MIDSOLE BODIES

CROSS-REFERENCE TO RELATED APPLICATION

The present disclosure claims priority to, and the benefit of, U.S. Provisional Patent Application No. 62/406,176, filed on Oct. 10, 2016.

TECHNICAL FIELD

The present teachings generally include a sole structure for an article of footwear. More specifically, the present disclosure describes an article of footwear with a sole structure that helps the wearer's heel-to-forefoot transition during a stride.

BACKGROUND

Footwear typically includes a sole structure configured to be located under a wearer's foot to space the foot away from the ground. Sole assemblies in athletic footwear are configured to provide desired cushioning, motion control, and resiliency.

DETAILED DESCRIPTION

Figure 1:
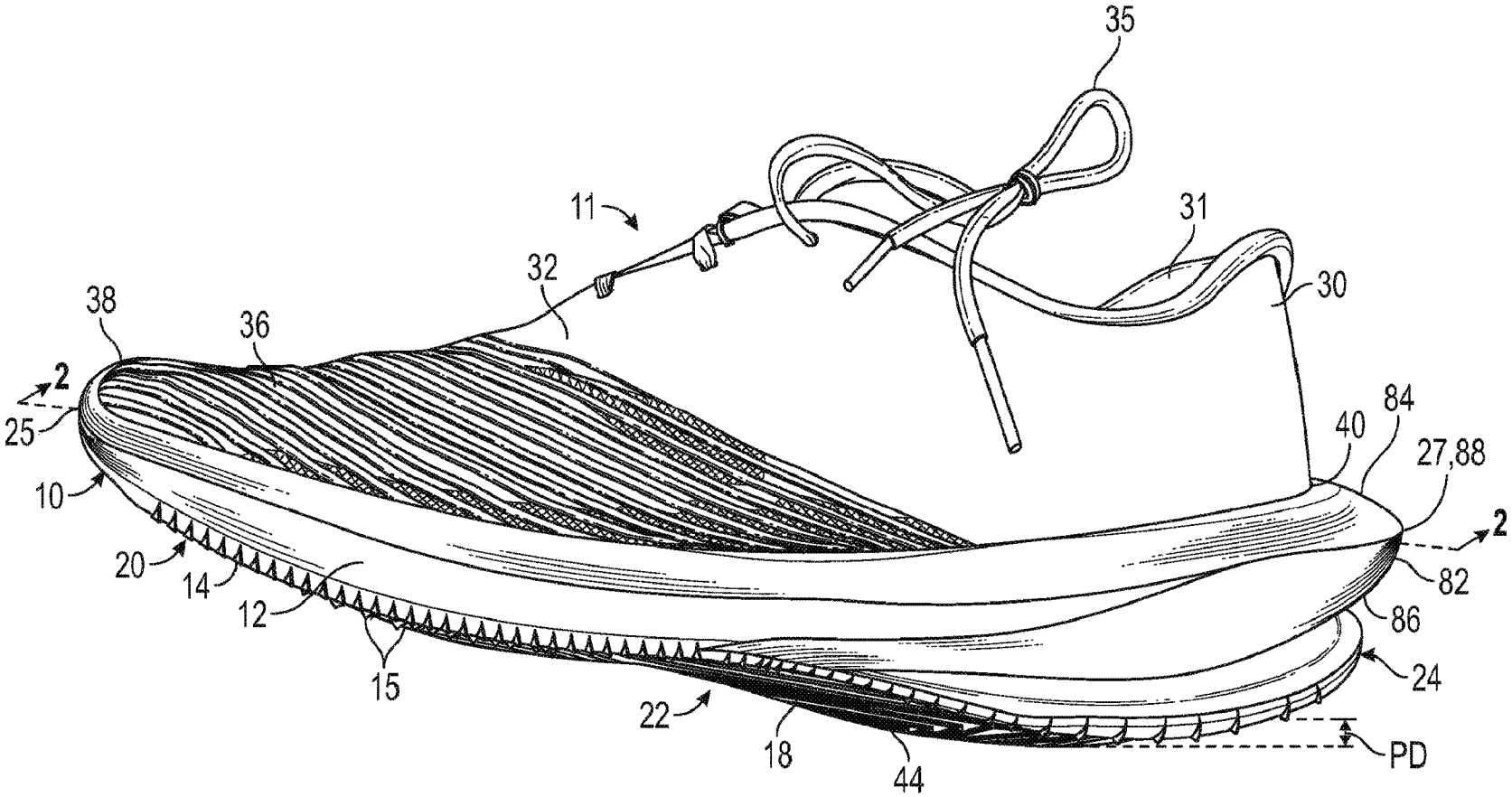
FIG. 1 is a schematic illustration in medial side view of an article of footwear for a wearer's right foot including an upper and a sole structure coupled to the upper.

A sole structure for an article of footwear includes a first midsole body defining a ground-facing surface and a foot-facing surface opposite the ground-facing surface. The first midsole body includes a first midsole material, which has a first hardness. The sole structure further includes a second midsole body extending through the first midsole body. As such, the second midsole body extends beyond the ground-facing surface of the first midsole body. The second midsole body includes a second midsole material, which has a second hardness. The first hardness is greater than the second hardness. In an embodiment, the first hardness is between ten and fifteen units greater than the second hardness on an Asker type C Durometer scale. The sole structure has a sole forefoot portion, a sole heel portion, and a sole midfoot portion between the sole forefoot portion and the sole heel portion. In an embodiment, the second midsole body has a variable height along the sole forefoot portion, the sole heel portion, and the sole midfoot portion. For example, the second midsole body may have a maximum height at the sole heel portion. The variable height of the second midsole body may be tapered toward the sole midfoot portion. As such, this variable height decreases from the sole heel portion toward the sole midfoot portion. The second midsole body defines an inner midsole surface and an outer midsole surface opposite the inner midsole surface. In an embodiment, a maximum protruding distance of the second midsole body is defined from the ground-facing surface of the first midsole body to the outer midsole surface of the second midsole body at the sole heel portion. In an embodiment, as a non-limiting example, the maximum protruding distance may be about three millimeters.

In an embodiment, the sole structure further includes an insole disposed over the first midsole body and the second midsole body. The insole defines an inner insole surface and an outer insole surface. The inner insole surface faces away the first midsole body. The outer insole surface faces toward the first midsole body. In an embodiment, the insole may define a plurality of openings extending through the inner insole surface and the outer insole surface to partially expose the second midsole body. As a non-limiting example, the insole may define a first opening disposed at the sole heel portion and a second opening disposed at the sole forefoot portion.

In an embodiment, the second midsole body includes a main body portion, a first body protrusion extending from the main body portion and into the first opening, and a second body protrusion extending from the main body portion and into the second opening. In an embodiment, the first body protrusion and the second body protrusion are flush with the inner insole surface. Each of the first body protrusion and the second body protrusion has a top protrusion surface exposed via the first opening and the second opening, respectively. The top protrusion surface may be textured to provide tactile feedback to a wearer. The first body protrusion may have a shape that is substantially similar to a shape of the first opening to allow the first body protrusion to be received by the first opening. The second body protrusion may have a shape that is substantially similar to a shape of the second opening to allow the second body protrusion to be received by the second opening. The shape of the first opening may be different from the shape of the second opening. The first midsole body may define a plurality of sipes extending into the ground-facing surface. As a non-limiting example, the sipes are arranged in a zig-zag pattern. The second midsole body defines an outermost perimeter. The second midsole body may further include a groove disposed around the outermost perimeter.

The sole structure can be combined with an upper. The upper is coupled to the sole structure. The upper includes a main upper portion, a forefoot lateral portion, and a forefoot medial portion. In an embodiment, the main upper portion interconnects the forefoot lateral portion and the forefoot medial portion. The main upper portion includes a first upper material. The forefoot lateral portion and the forefoot medial portion each include a second upper material. The first upper material has a first elastic modulus. The second upper material has a second elastic modulus. The second elastic modulus may be greater than the first elastic modulus.

In an embodiment, the sole structure has a sole forefoot portion, a sole heel portion, and a sole midfoot portion between the sole forefoot portion and the sole heel portion.

The main upper portion defines a foremost main end. The main upper portion defines a rearmost main end opposite the foremost main end. The foremost main end of the main upper portion may be fixed to the sole forefoot portion of the sole structure. The rearmost main end of the main upper portion may be fixed to the sole heel portion of the sole structure.

In an embodiment, the upper defines a foremost upper end and a rearmost upper end opposite the foremost upper end. In an embodiment, the sole structure includes a heel bump extending from the first midsole body away from the foremost upper end such that the heel bump extends beyond the rearmost upper end. The heel bump defines an upper bump surface, a lower bump surface, and an apex, at which the upper bump surface and the lower bump surface meet. In an embodiment, the sole structure further comprises a blown rubber layer at least partially coating the ground-facing surface. The second midsole body defines an outer midsole surface. The second midsole body defines an inner midsole surface opposite the outer midsole surface. The sole structure may include a blown rubber layer partially coating the outer midsole surface. The second midsole body includes a midsole heel portion, a midsole forefoot portion, and a midsole midfoot portion between the midsole heel portion and the midsole forefoot portion. The midsole heel portion may have a camber. The second midsole body may be tapered along the midsole midfoot portion and the midsole forefoot portion such that a width of the second midsole body decreases from the midsole midfoot portion toward the midsole forefoot portion.

The present disclosure also describes an article of footwear. The article of footwear includes an upper and a sole structure coupled to the upper. The sole structure includes a first midsole body defining a ground-facing surface and a foot-facing surface opposite the ground-facing surface. The first midsole body includes a first midsole material, which has a first hardness. The sole structure further includes a second midsole body extending through the first midsole body. As such, the second midsole body extends beyond the ground-facing surface of the first midsole body. The second midsole body includes a second midsole material, which has a second hardness. The first hardness is greater than the second hardness. As a non-limiting example, the first hardness is between ten and fifteen units greater than the second hardness on an Asker type C Durometer scale. The sole structure has a sole forefoot portion, a sole heel portion, and a sole midfoot portion between the sole forefoot portion and the sole heel portion. The second midsole body has a variable height along the sole forefoot portion, the sole heel portion, and the sole midfoot portion. In an embodiment, the second midsole body has a maximum height at the sole heel portion. The variable height of the second midsole body may be tapered toward the sole midfoot portion. As such, this variable height decreases from the sole heel portion toward the sole midfoot portion. The second midsole body defines an inner midsole surface and an outer midsole surface opposite the inner midsole surface. A maximum protruding distance of the second midsole body is defined from the ground-facing surface of the first midsole body to the outer midsole surface of the second midsole body at the sole heel portion. This maximum protruding distance may be about three millimeters.

In an embodiment, the sole structure further includes an insole disposed over the first midsole body and the second midsole body. The insole defines an inner insole surface and an outer insole surface. The inner insole surface faces away the first midsole body. The outer insole surface faces toward the first midsole body. The insole may define a plurality of openings extending through the inner insole surface and the outer insole surface to partially expose the second midsole body. As a non-limiting example, the insole defines a first opening disposed at the sole heel portion and a second opening disposed at the sole forefoot portion.

In an embodiment, the second midsole body includes a main body portion, a first body protrusion extending from the main body portion and into the first opening, and a second body protrusion extending from the main body portion and into the second opening. In an embodiment, the first body protrusion and the second body protrusion are flush with the inner insole surface. Each of the first body protrusion and the second body protrusion has a top protrusion surface exposed via the first opening and the second opening, respectively. The top protrusion surface may be textured to provide tactile feedback to a wearer. The first body protrusion may have a shape that is substantially similar to a shape of the first opening to allow the first body protrusion to be received by the first opening. The second body protrusion may have a shape that is substantially similar to a shape of the second opening to allow the second body protrusion to be received by the second opening. The shape of the first opening may be different from the shape of the second opening. In an embodiment, the first midsole body defines a plurality of sipes extending into the ground-facing surface. As a non-limiting example, the sipes are arranged in a zig-zag pattern. The second midsole body defines an outermost perimeter. The second midsole body may further include a groove disposed around the outermost perimeter.

In an embodiment, the upper is coupled to the sole structure and includes a main upper portion, a forefoot lateral portion, and a forefoot medial portion. The main upper portion interconnects the forefoot lateral portion and the forefoot medial portion. The main upper portion includes a first upper material. The forefoot lateral portion and the forefoot medial portion each include a second upper material. The first upper material has a first elastic modulus, and the second upper material has a second elastic modulus. The second elastic modulus may be greater than the first elastic modulus.

In an embodiment, the sole structure has a sole forefoot portion, a sole heel portion, and a sole midfoot portion between the sole forefoot portion and the sole heel portion. The main upper portion defines a foremost main end and a rearmost main end opposite the foremost main end. The foremost main end of the main upper portion may be fixed to the sole forefoot portion of the sole structure. The rearmost main end of the main upper portion may be fixed to the sole heel portion of the sole structure. The upper defines a foremost upper end and a rearmost upper end opposite the foremost upper end.

In an embodiment, the sole structure includes a heel bump extending from the first midsole body away from the foremost upper end such that the heel bump extends beyond the rearmost upper end. The heel bump defines an upper bump surface, a lower bump surface, and an apex, at which the upper bump surface and the lower bump surface meet. In an embodiment, the article of footwear may include a blown rubber layer at least partially coating the ground-facing surface.

In an embodiment, the second midsole body defines an outer midsole surface and an inner midsole surface opposite the outer midsole surface. The sole structure further includes a blown rubber layer partially coating the outer midsole surface. The second midsole body includes a midsole heel portion, a midsole forefoot portion, and a midsole midfoot portion between the midsole heel portion and the midsole forefoot portion. In an embodiment, the midsole heel portion has a camber. The second midsole body may be tapered along the midsole midfoot portion and the midsole forefoot portion such that a width of the second midsole body decreases from the midsole midfoot portion toward the midsole forefoot portion.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims. The invention illustratively disclosed herein may be practiced in the absence of any element which is not specifically disclosed herein.

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole structure). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed farther from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

Referring to the drawings, wherein like reference numbers refer to like components throughout the views, FIGS. 1-6 show a sole structure 10 for an article of footwear 11. As discussed below, the geometry of the components of the sole structure 10 encourages a proper heel-to-forefoot transition during a wearer's stride. The sole structure 10 provides traction, imparts stability, and limits various foot motions and includes a first midsole body 12 defining a ground-facing surface 14 and a foot-facing surface 16 opposite the ground-facing surface 14. In an embodiment, the sole structure 10 may include traction elements 15. The traction elements 15 may be integrally formed as part of the first midsole body 12 or may be attached to she first midsole body 12, or may be formed with or attached to another plate underlying the first midsole body 12. The traction elements 15 protrude below the ground-facing surface 14 of the first midsole body 12. In an embodiment, the traction elements could include cleats or spikes.

The foot-facing surface 16 of the first midsole body 12 supports the foot directly or indirectly through an overlying insole layer. The first midsole body 12 includes a first midsole material. In other words, the first midsole body 12 is wholly or partly made of the first midsole material. This first midsole material may be, for example, a polymeric foam or other suitably durable material, such as a thermoplastic. As a non-limiting example, this first midsole material may at least partly include ethylene vinyl acetate (EVA). As a non-limiting example, this first midsole material may be sixty percent EVA and forty percent rubber to minimize the weight of the first midsole body 12. In an embodiment, the first midsole material is a polymeric foam sold under the trademark LUNARLON®. Irrespective of the specific material employed, the first midsole material has a specific hardness, which, in the present disclosure, is referred to as the first hardness. In the present disclosure, the term "hardness" means a measure of how resistant solid matter is to various kinds of permanent shape change when a compressive force is applied to that solid matter. The materials mentioned in this disclosure were measured on an Asker Type C Durometer scale.

The first midsole body 12 is a single, unitary component in the embodiment shown, but in other embodiments could be multiple interconnected components. For example, both the foot-facing surface 16 and the opposite ground-facing surface 14 may be pre-formed with some amount of curvature and variations in thickness when molded or otherwise formed in order to provide a shaped footbed and/or increased thickness for reinforcement in desired areas. For example, the first midsole body 12 could have a curved or contoured geometry that may be similar to the lower contours of the foot. For example, the first midsole body 12 may have a contoured periphery that slopes upward toward any overlaying layers, such as the upper 30.

The sole structure 10 further includes a second midsole body 18 extending through the first midsole body 12. As such, the second midsole body extends beyond the ground-facing surface 14 of the first midsole body 12. The second midsole body 18 includes a second midsole material. In other words, the second midsole body 18 is wholly or partly made of the second midsole material. This second midsole material may be a polymeric foam that attenuates ground reaction forces (i.e., provides cushioning) during walking, running, and other ambulatory activities. The second midsole material may be an injected urethane foam. As a non-limiting example, this second midsole material may be a thermoplastic polyurethane foam that attenuates the impact of the heel strike during walking, running, and other ambulatory activities and helps the wearer transition its weight from the heel to ball of the foot and the toes for push off. This second midsole material has a second hardness that is less than the first hardness of the first midsole material (described above). In other words, the first hardness of the first midsole material is greater than the second hardness of the second midsole material in order to enhance and/or correct a wearer's stride (including the transition from the heel strike to the forefoot strike) during walking, running, and other ambulatory activities. In particular, the first hardness is between ten and fifteen units greater than the second hardness on an Asker type C Durometer scale in order to enhance and/or correct the stride of the wearer of the article of footwear 11. Further, in one or more embodiments, the first hardness may be between fifteen and twenty five units greater than the second hardness on an Asker type C Durometer scale in order to enhance and/or correct the stride of the wearer of the article of footwear 11.

The sole structure 10 may be divided into the sole forefoot portion 20, the sole midfoot portion 22, and the sole heel portion 24. The sole midfoot portion is between the sole heel portion 24 and the sole forefoot portion 20. The sole forefoot portion 20 may be generally associated with the toes and joints connecting the metatarsals with the phalanges. The sole midfoot portion 22 may be generally associated with the arch of a foot. The sole heel portion 24 may be generally associated with the heel of a foot, including the calcaneus bone. In addition, the sole structure 10 may include a sole lateral side 26 and a sole medial side 28. In particular, the sole lateral side 26 and the sole medial side 28 may be opposing sides of the sole structure 10. Furthermore, both the sole lateral side 26 and the sole medial side 28 may extend through the sole forefoot portion 20, the sole midfoot portion 22, and the sole heel portion 24. As used herein, a lateral side of a component for the article of footwear 11, including the sole lateral side 26, is a side that corresponds with an outside area of the human foot (i.e., the side closer to the fifth toe of the wearer). The fifth toe is commonly referred to as the little toe. A medial side of a component for an article of footwear, including the sole medial side 28, is the side that corresponds with an inside area of the human foot (i.e., the side closer to the hallux of the foot of the wearer). The hallux is commonly referred to as the big toe. Both the sole lateral side 26 and the sole medial side 28 extend from a foremost extent 25 to a rearmost extent 27 of a periphery of the sole structure 10.

The article of footwear 11 further includes an upper 30 coupled to the sole structure 10. In particular, the upper 30 may have any design, shape, size and/or color. For example, in embodiments where the article of footwear 11 is a basketball shoe, the upper 30 could be a high top upper that is shaped to provide high support on an ankle. In embodiments where article of footwear 11 is a running shoe or golf shoe, the upper 30 could be a low top upper. In some embodiments, the upper 30 includes an ankle opening 31 that provides entry for the foot into an interior cavity of upper 30. In some embodiments, the upper 30 may also include a tongue 33 (FIG. 4) that provides cushioning and support across the instep of the foot. Some embodiments may include fastening provisions, including, but not limited to: laces, cables, straps, buttons, zippers as well as any other provisions known in the art for fastening articles. In some embodiments, a lace 35 may be applied at a fastening region of the upper 30.

Some embodiments may include uppers 30 that extend beneath the foot, thereby providing three hundred sixty degrees coverage at some regions of the foot. However, other embodiments need not include uppers that extend beneath the foot. In other embodiments, for example, the upper 30 could have a lower periphery joined with a sole structure and/or a strobel or sock liner.

Figure 4:
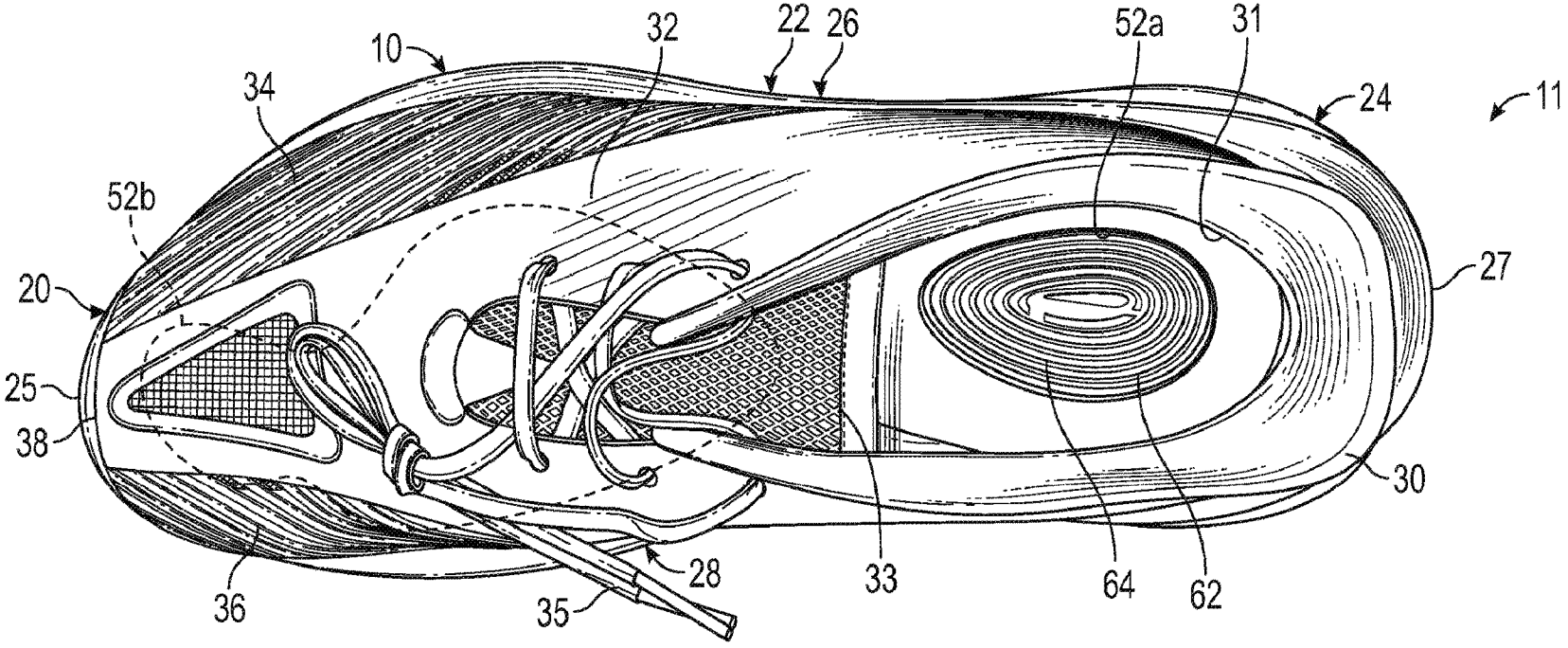
FIG. 4 is a schematic illustration in top view of the article of footwear shown in FIG. 1.
Figure 5:
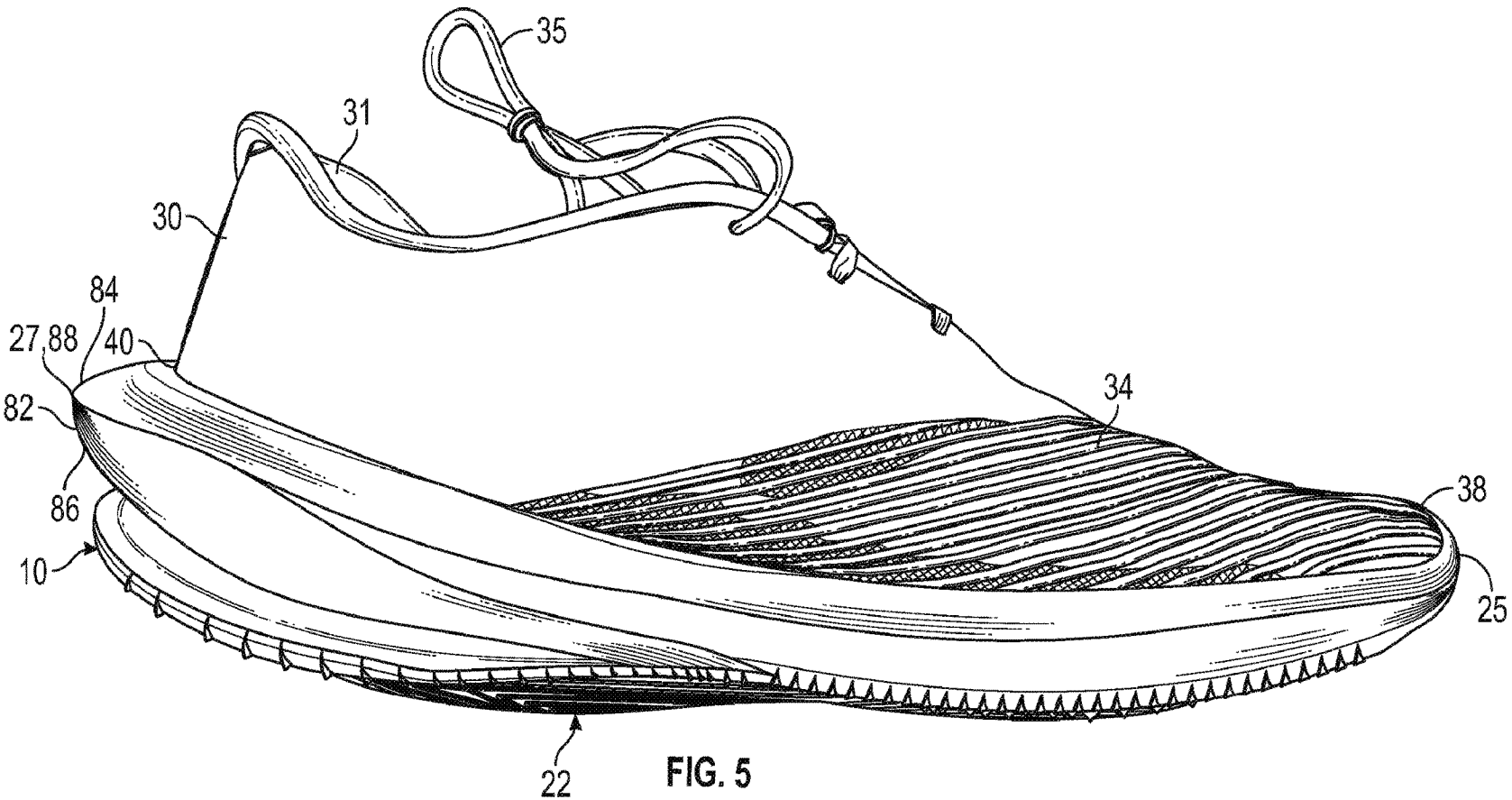
FIG. 5 is a schematic illustration in lateral side view of the article of footwear shown in FIG. 1.

With specific reference to FIGS. 1, 4, and 5, the upper 30 includes a main upper portion 32, a forefoot lateral portion 34, and a forefoot medial portion 36. The main upper portion 32 interconnects the forefoot lateral portion 34 and the forefoot medial portion 36. The main upper portion 32 includes a first upper material. In other words, the main upper portion 32 is wholly or partly made of the first upper material. The first upper material may be a fused polymeric material with limited (or virtually no) elasticity. The forefoot lateral portion 34 and the forefoot medial portion 36 each include a second upper material. In other words, the forefoot lateral portion 34 and the forefoot medial portion 36 each are wholly or partly made of a second upper material. The second upper material is a polymeric mesh material capable of providing elasticity to the upper 30. As non-limiting examples, the second upper material may be of braided construction, a knitted (e.g., warp-knitted) construction or a woven construction. Regardless of the specific material employed, the first upper material has a first elastic modulus, and the second upper material has a second elastic modulus, which is less than the first elastic modulus. In other words, the first elastic modulus of the first upper material is greater than the second elastic modulus of the second upper material in order to maximize rigidity along the longitudinal direction of the article of footwear 11 while allowing flexibility along the lateral-medial direction, thereby enhancing the wearer's stride during walking, running, and other ambulatory activities. The longitudinal direction of the sole structure 10 extends along a length of the sole structure 10, e.g., from the sole forefoot portion 20 to the sole heel portion 24 of the sole structure 10. The term "forward" is used to refer to the general direction from the sole heel portion 24 toward the sole forefoot portion 20, and the term "rearward" is used to refer to the opposite direction, i.e., the direction from the sole forefoot portion 20 toward the sole heel portion 24.

With continued reference to FIGS. 1, 4, and 5, the main upper portion 32 defines a foremost main end 38 and a rearmost main end 40 opposite the foremost main end 38. The foremost main end 38 of the main upper portion 32 is fixed to the sole forefoot portion 20 of the sole structure 10, and the rearmost main end 40 of the main upper portion 32 is fixed to the sole heel portion 24 of the sole structure 10 in order form a lockout upper portion with limited or no elasticity. This lockout upper portion is a non-stretch zone that, while the forefoot lateral portion 34 and the forefoot medial portion 36 are stretch zones that provide a desired degree of elasticity, support, and/or comfort along the lateral-medial direction of the sole structure 10. The forefoot lateral portion 34, the forefoot medial portion 36, and the main upper portion 32 may provide dimensional variation (e.g., thickness) and/or permeability (e.g., breathability) characteristics.

With specific reference to FIGS. 1, 2, 4, and 5, the second midsole body 18 defines an inner midsole surface 42 and an outer midsole surface 44 opposite the inner midsole surface 42. The second midsole body 18 has a variable height SH (FIG. 2) along the sole forefoot portion 20, the sole heel portion 24, and the sole midfoot portion 22. The variable height SH is the distance from the inner midsole surface 42 to the outer midsole surface 44. The second midsole body 18 has a maximum height MH at the sole heel portion 24. The variable height SH of the second midsole body 18 is tapered toward the sole midfoot portion 22. As such, this variable height SH decreases from the sole heel portion 24 toward the sole midfoot portion 22. A maximum protruding distance PD (FIG. 1) of the second midsole body 18 is defined from the ground-facing surface 14 of the first midsole body 12 to the outer midsole surface 44 of the second midsole body 18 at the sole heel portion 24. In the embodiment shown, this maximum protruding distance PD is about three millimeters in order to attenuate the impact of the heel strike during walking, running, and other ambulatory activities. In other embodiments, the maximum protruding distance may be different than 3 millimeters.

Figure 2:
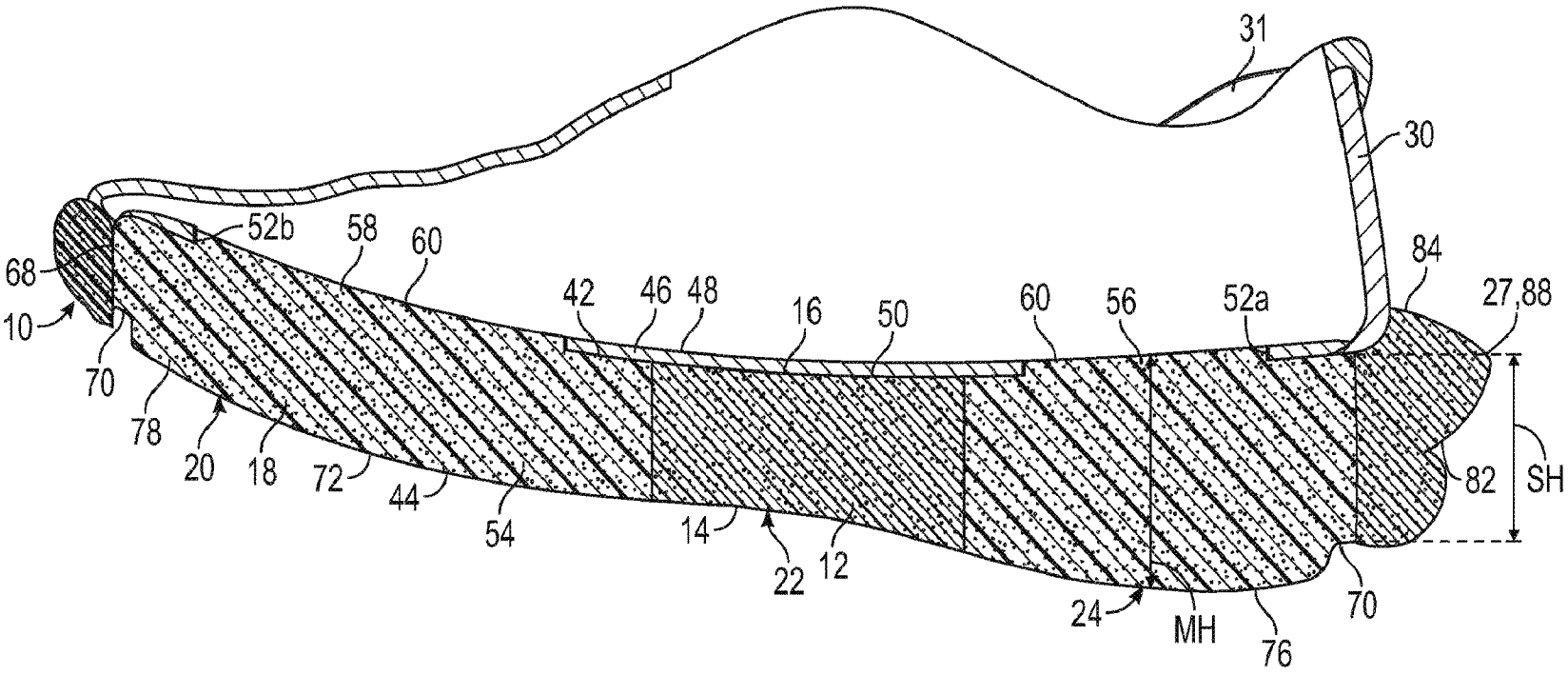
FIG. 2 is a schematic cross-sectional illustration of the sole structure of FIG. 1, taken at lines 2-2 in FIG. 1.

Referring to FIG. 2, the sole structure 10 further includes an insole 46 disposed over the first midsole body 12 and the second midsole body 18. The insole 46 may be joined (e.g., stitched or glued) to a lower portion of the upper 30 for purposes of securing the sole structure 10 to the upper 30. Alternatively, the insole 46 could be a drop-in, selectively removable component. The upper 30 could also be stitched or bonded to the first midsole body 16. The insole 46 defines an inner insole surface 48 and an outer insole surface 50 opposite the inner insole surface 48. The inner insole surface 48 faces away the first midsole body 12. The outer insole surface 50 faces toward the first midsole body 12. The insole 46 defines a plurality of openings 52*a*, 52*b* extending through the inner insole surface 48 and the outer insole surface 50 to partially expose the second midsole body 18. As a non-limiting example, the insole 46 defines a first opening 52*a* disposed at the sole heel portion 24 and a second opening 52*b* disposed at the sole forefoot portion 20.

Figure 6:
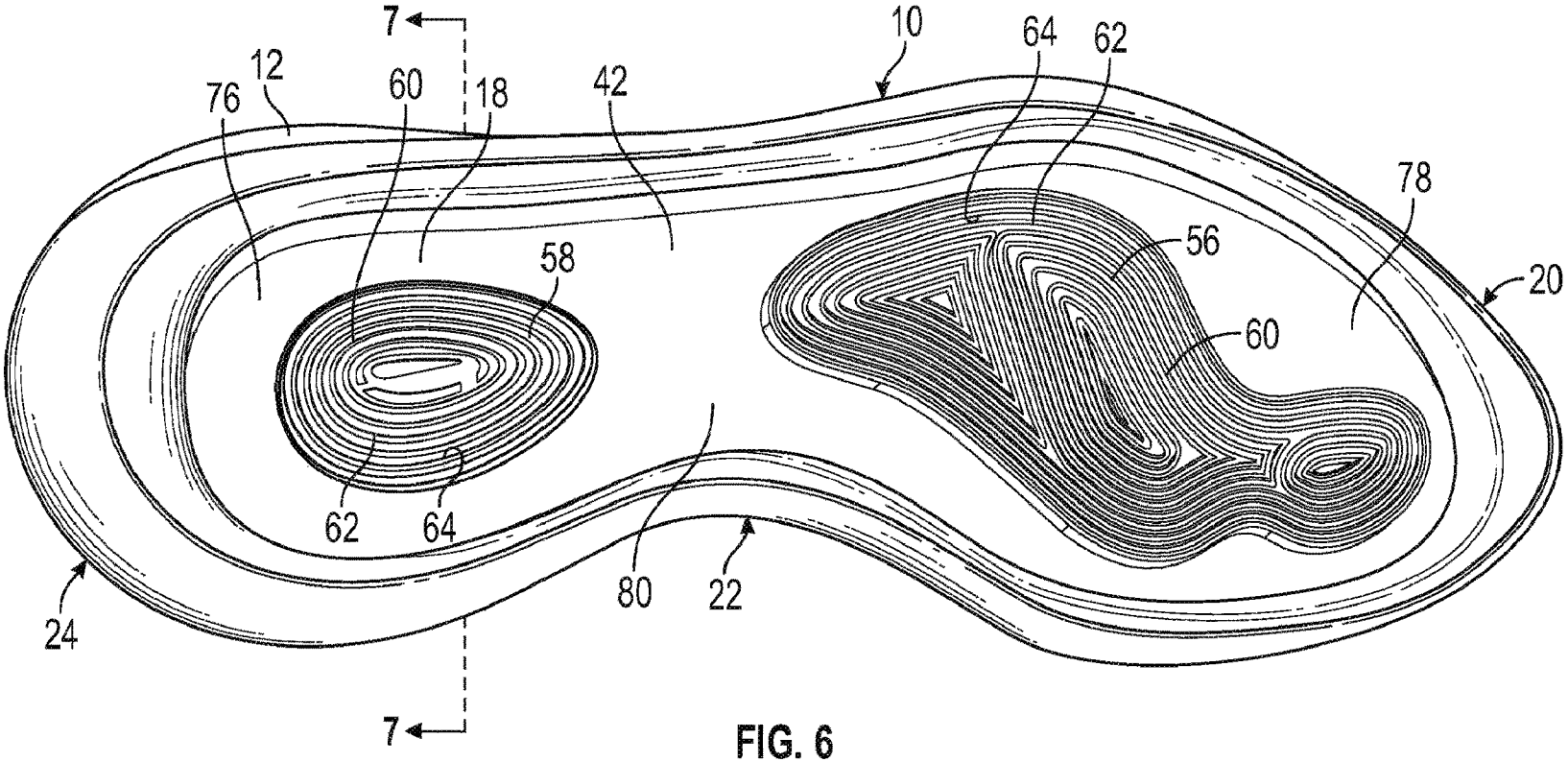
FIG. 6 is a schematic illustration in top view of the sole structure of the article of footwear shown in FIG. 1 for a wearer's left foot.
Figure 7:
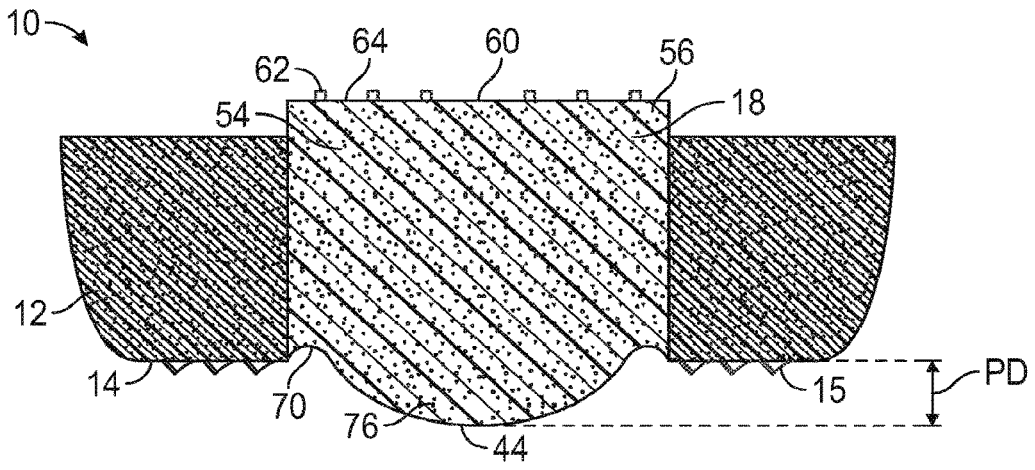
FIG. 7 is a schematic illustration in cross-sectional view of the sole structure of FIG. 6, taken along section lines 7-7 in FIG. 6.
Figure 8:
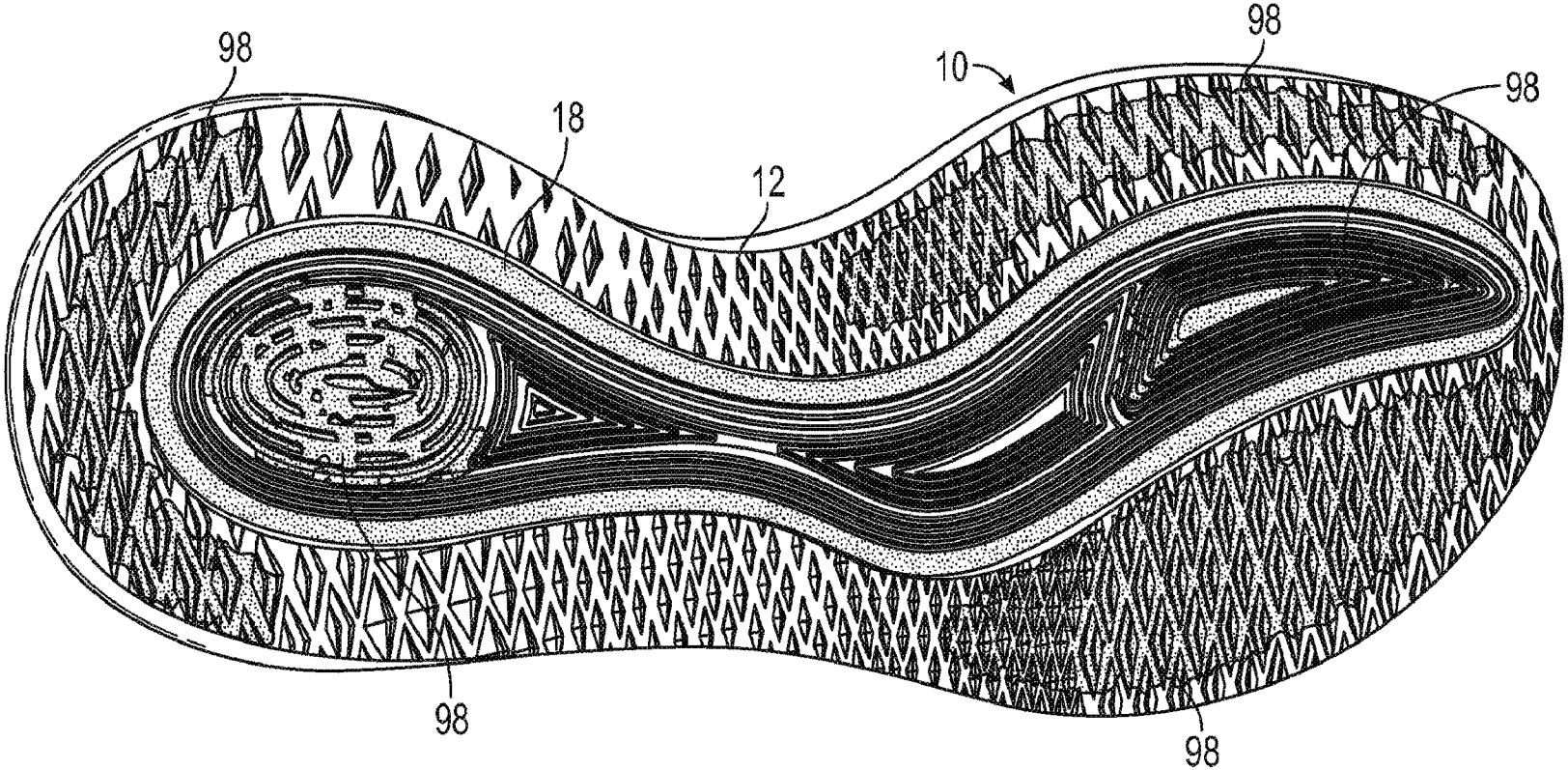
FIG. 8 is a schematic illustration in bottom view of the sole structure of FIG. 6, including blown rubber layers coating parts of the ground-facing surface of the sole structure.

With specific reference to FIGS. 2 and 6, the second midsole body 18 includes a main body portion 54, a first body protrusion 56 extending from the main body portion 54 and into the first opening 52*a*, and a second body protrusion 58 extending from the main body portion 54 and into the second opening 52*b*. It should be appreciated that FIGS. 6-8 show a sole structure for an opposite foot (left foot) than in shown in FIGS. 1-5 (sole structure 20 is for a right foot). The articles of footwear for each foot are, however, mirror images of one another, and like components are identified with the identical reference numbers. In the embodiment shown, the first body protrusion 56 and the second body protrusion 58 are flush with the inner insole surface 48 to maximize comfort. In the present disclosure, the term "flush" means that the inner insole surface 48 is substantially flush with the first body protrusion 56 and the second body protrusion 58 when no load is applied to the sole structure 10 and taking into account manufacturing tolerances. Accordingly, the first body protrusion 56 and the second body protrusion 58 are not necessarily perfectly flush with the inner insole surface 48. In other embodiments within the scope of the present teachings, the first body protrusion 56 and the second body protrusion 58 need not be flush with the inner insole surface 48, and could instead extend above the inner insole surface 48.

Each of the first body protrusion 56 and the second body protrusion 58 has a top protrusion surface 60 exposed via the first opening 52*a* and the second opening 52*b*, respectively. The top protrusion surface 60 is textured to provide tactile feedback to a wearer. As non-limiting example, the texture of each top protrusion surface 60 of the first body protrusion 56 and the second body protrusion 58 includes raised portions 62 and undulated channels 64. The first body protrusion 56 has a shape that is substantially similar to a shape of the first opening 52*a* to allow the first body protrusion 56 to be received by the first opening 52*a*. The second body protrusion 58 has a shape that is substantially similar to a shape of the second opening 52*b* to allow the second body protrusion 58 to be received by the second opening 52*b*. Further, the shape of the first opening 52*c* is different from the shape of the second opening 52*b* to provide a different tactile feedback to the wearer during the heel strike and the forefoot strike. The shapes of the first opening 52*a* and second opening 52*b*, along with the corresponding shapes of the first body protrusion 56 and second body protrusion 58 together generally correspond with relatively highly loaded regions of the foot during a foot stride.

Figure 3:
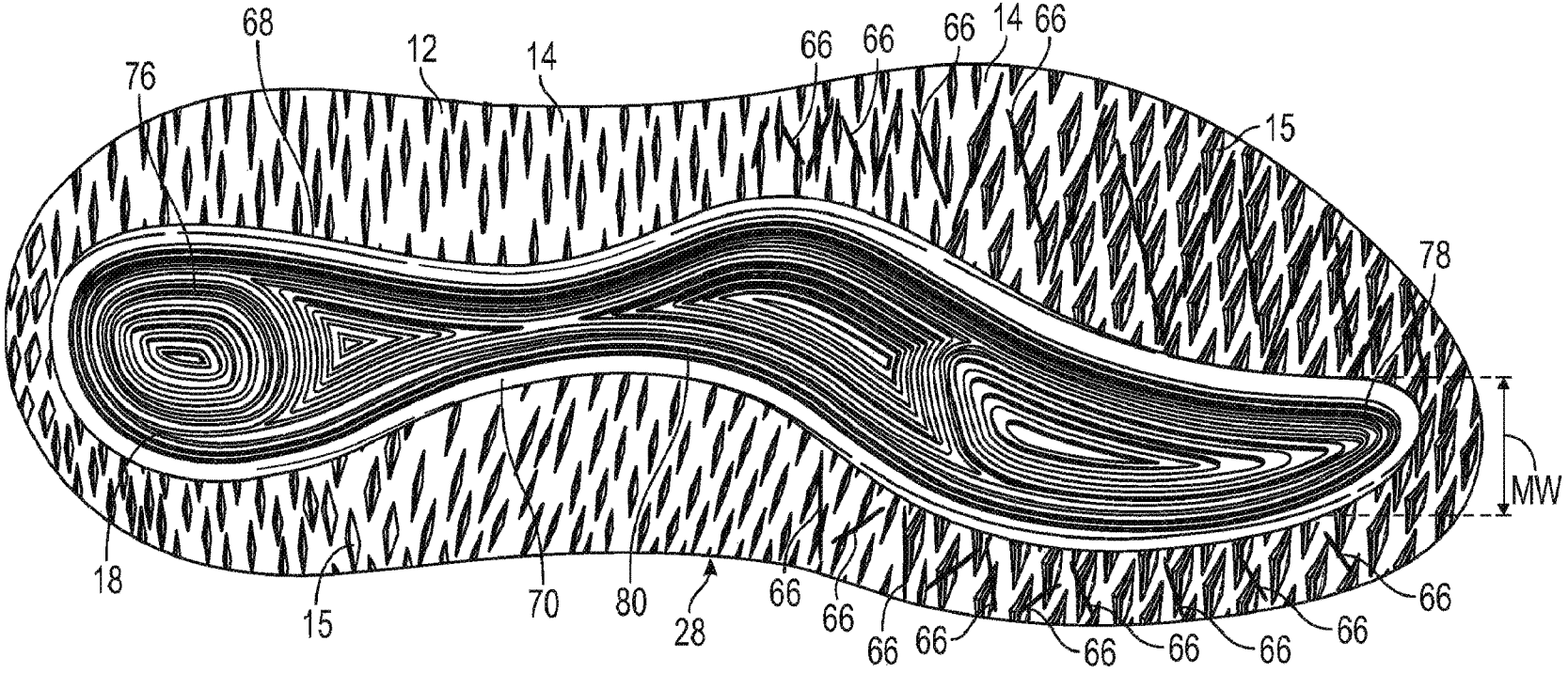
FIG. 3 is a schematic illustration in bottom view of the article of footwear shown in FIG. 1.

With specific reference to FIG. 3, the first midsole body 12 defines a plurality of sipes 66 extending into the ground-facing surface 14 to provide flexibility to the first midsole body 12. In the present disclosure, the term "sipe" means a groove or channel capable of changing shape (e.g., expanding) during the wearer's stride to provide flexibility to the first midsole body 12. The enhanced flexibility provided by the sipes 66 facilitate the wearer's stride during motion through the forefoot. The sipes 66 are arranged in a zig-zag pattern but are not necessarily connected to one another. It is contemplated, however, that the sipes 66 defining the zig-zag pattern may be connected to one another. The zig-zag pattern of the sipes 66 also maximizes the flexibility of the first midsole body 12. Moreover, the second midsole body 18 defines an outermost perimeter 68 and includes a groove 70 disposed along the outermost perimeter 68. The groove 70 provides flexibility between the first midsole body 12 and the second midsole body 18, thereby better enabling feedback of ground reaction forces to the foot through the second midsole body 18.

With specific reference to FIGS. 2, 3, and 6, the second midsole body 18 includes a midsole heel portion 76, a midsole forefoot portion 78, and a midsole midfoot portion 80 between the midsole heel portion 76 and the midsole forefoot portion 78. The midsole heel portion 76 has a camber. As used herein, the term "camber" means a convex shape. As such, the outer midsole surface 44 of the second midsole body 18 has a convex shape at the midsole heel portion 76, both in the longitudinal direction and in the transverse direction. As discussed above, the second midsole body 18 defines a maximum protruding distance PD from the ground-facing surface 14 of the first midsole body 12 to the outer midsole surface 44 of the second midsole body 18 at the midsole heel portion 76. The maximum protruding distance PD, which is about three millimeters, and the camber of the second midsole body 18 at the midsole heel portion 76 attenuate the impact of a heel strike during a wearer's stride. Moreover, the second midsole body 18 is tapered along the midsole midfoot portion 80 and the midsole forefoot portion 78 such that a width MW of the second midsole body 18 decreases from the midsole midfoot portion 80 toward the midsole forefoot portion 78 to help the wearer transition from a narrower support structure to a wider supper structure as the foot transitions toward the ball of the foot and the big toe for the eventual push off. Thus, the geometry of the second midsole body 18 (as arranged relative to the first midsole body 12) encourages a proper heel-to-forefoot transition during a wearer's stride. The second midsole body 18 is also convex at the outer midsole surface 44 in the forefoot portion, and is convex in the transverse direction both in the heel portion as well as in the forefoot portion, all of which promote tactile feedback and awareness of foot position.

With reference to FIGS. 1, 2, and 5, the sole structure 10 includes a heel bump 82 extending from the first midsole body 12 away from the foremost main end 38. As such, the heel bump 82 extends beyond the rearmost main end 40 to allow the user to remove the article of footwear 11 from the foot by pushing the sole structure 10 downwardly through the heel bump 82, such as by pushing on the heel bump 82 with the article of footwear on the opposite foot, or with the opposite foot itself. The heel bump 82 defines an upper bump surface 84, a lower bump surface 86, and an apex 88, at which the upper bump surface 84 and the lower bump surface 86 meet. The apex 88 may be the rearmost extent 27 of the sole structure 10.

Referring to FIG. 8, one or more blown rubber layers 98 may be added to in high wear areas of the first midsole body 12. Specifically, one or more blown rubber layers 98 may wholly or partly coat the ground-facing surface 14 of the first midsole body 12 in order to maximize the useful life of the sole structure 10. As non-limiting example, only high wear areas of the ground-facing surface 14 of the first midsole body 12 may be coated with blown rubber layers 98. The blown rubber layers 98 may be wholly or partly made of carbon rubber. Carbon rubber is synthetic rubber with carbon added. Regardless of the specific material used, the blown rubber layers 98 may be formed from a material that has comparatively higher rubber content and/or other additives to increase the hardness and wear resistance of these. One or more blown rubber layer 98 may wholly or partly coat the outer midsole surface 72 of the second midsole body 18. For instance, only high wear areas of the outer midsole surface 72 may be coated with blown rubber layers 98.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear, comprising:

a first midsole body defining a ground-facing surface and a foot-facing surface opposite the ground-facing surface, wherein the first midsole body includes a first midsole material, and the first midsole material has a first hardness; and a second midsole body extending through the first midsole body such that the second midsole body extends beyond the ground-facing surface of the first midsole body, wherein the second midsole body includes a second midsole material, the second midsole material has a second hardness, and the first hardness is greater than the second hardness;

wherein the second midsole body includes a midsole heel portion, a midsole forefoot portion, and a midsole midfoot portion between the midsole heel portion and the midsole forefoot portion;

wherein the midsole heel portion has a camber; and wherein the second midsole body is tapered along the midsole midfoot portion and the midsole forefoot portion such that a width of the second midsole body decreases from the midsole midfoot portion toward the midsole forefoot portion.

2. The sole structure of claim 1, wherein the first hardness is between ten and fifteen units greater than the second hardness on an Asker type C Durometer scale.

3. The sole structure of claim 1, wherein:

the sole structure has a sole forefoot portion, a sole heel portion, and a sole midfoot portion between the sole forefoot portion and the sole heel portion;

the second midsole body has a variable height along the sole forefoot portion, the sole heel portion, and the sole midfoot portion;

the second midsole body has a maximum height at the sole heel portion; and the variable height of the second midsole body is tapered toward the sole midfoot portion such that the variable height decreases from the sole heel portion toward the sole midfoot portion.

4. The sole structure of claim 3, wherein:

the second midsole body defines an inner midsole surface and an outer midsole surface opposite the inner midsole surface;

a maximum protruding distance of the second midsole body is defined from the ground-facing surface of the first midsole body to the outer midsole surface of the second midsole body at the sole heel portion; and the maximum protruding distance is about three millimeters.

5. The sole structure of claim 4, wherein:

the sole structure further comprises an insole disposed over the first midsole body and the second midsole body;

the insole defines an inner insole surface and an outer insole surface;

the inner insole surface faces away the first midsole body;

the outer insole surface faces toward the first midsole body; and the insole defines a plurality of openings extending through the inner insole surface and the outer insole surface to partially expose the second midsole body.

6. The sole structure of claim 5, wherein the plurality of openings includes a first opening disposed at the sole heel portion and a second opening disposed at the sole forefoot portion.

7. The sole structure of claim 6, wherein the second midsole body includes:

a main body portion;

a first body protrusion extending from the main body portion and into the first opening; and a second body protrusion extending from the main body portion and into the second opening.

8. The sole structure of claim 7, wherein the first body protrusion and the second body protrusion are flush with the inner insole surface.

9. The sole structure of claim 8, wherein:

each of the first body protrusion and the second body protrusion has a top protrusion surface exposed via the first opening and the second opening, respectively; and the top protrusion surface is textured to provide tactile feedback to a wearer.

10. The sole structure of claim 9, wherein:

the first body protrusion has a shape that is substantially similar to a shape of the first opening to allow the first body protrusion to be received by the first opening; and the second body protrusion has a shape that is substantially similar to a shape of the second opening to allow the second body protrusion to be received by the second opening.

11. The sole structure of claim 10, wherein the shape of the first opening is different from the shape of the second opening.

12. The sole structure of claim 1, wherein the first midsole body defines a plurality of sipes extending into the ground-facing surface.

13. The sole structure of claim 12, wherein the sipes are arranged in a zig-zag pattern.

14. The sole structure of claim 1, wherein:

the second midsole body defines an outermost perimeter; and the second midsole body further includes a groove disposed around the outermost perimeter.

15. The sole structure of claim 1 in combination with an upper, wherein:

the upper is coupled to the sole structure;

the upper includes a main upper portion, a forefoot lateral portion, and a forefoot medial portion;

the main upper portion interconnects the forefoot lateral portion and the forefoot medial portion;

the main upper portion includes a first upper material;

the forefoot lateral portion and the forefoot medial portion each include a second upper material;

the first upper material has a first elastic modulus;

the second upper material has a second elastic modulus; and the first elastic modulus is greater than the second elastic modulus.

16. The sole structure of claim 15, wherein:

the sole structure has a sole forefoot portion, a sole heel portion, and a sole midfoot portion between the sole forefoot portion and the sole heel portion;

the main upper portion defines a foremost main end;

the main upper portion defines a rearmost main end opposite the foremost main end;

the foremost main end of the main upper portion is fixed to the sole forefoot portion of the sole structure; and the rearmost main end of the main upper portion is fixed to the sole heel portion of the sole structure.

17. The sole structure of claim 15, wherein:

the upper defines a foremost upper end and a rearmost upper end opposite the foremost upper end;

the sole structure includes a heel bump extending from the first midsole body away from the foremost upper end such that the heel bump extends beyond the rearmost upper end; and the heel bump defines an upper bump surface, a lower bump surface, and an apex, at which the upper bump surface and the lower bump surface meet.

18. The sole structure of claim 1, further comprising a blown rubber layer at least partially coating the ground-facing surface.

19. The sole structure of claim 1, wherein:

the second midsole body defines an outer midsole surface;

the second midsole body defines an inner midsole surface opposite the outer midsole surface; and the sole structure further comprises a blown rubber layer partially coating the outer midsole surface.

20. An article of footwear, comprising:

an upper;

a sole structure coupled to the upper, wherein the sole structure includes:

a first midsole body defining a ground-facing surface and a foot-facing surface opposite the ground-facing surface, wherein the first midsole body includes a first midsole material, and the first midsole material has a first hardness; and a second midsole body extending through the first midsole body such that the second midsole body extends beyond the ground-facing surface of the first midsole body, wherein the second midsole body includes a second midsole material, the second midsole material has a second hardness, and the first hardness is greater than the second hardness;

wherein the second midsole body includes a midsole heel portion, a midsole forefoot portion, and a midsole midfoot portion between the midsole heel portion and the midsole forefoot portion;

wherein the midsole heel portion has a camber; and wherein the second midsole body is tapered along the midsole midfoot portion and the midsole forefoot portion such that a width of the second midsole body decreases from the midsole midfoot portion toward the midsole forefoot portion.

* * * * *